US008123208B2

(12) United States Patent
Cracknell et al.

(10) Patent No.: US 8,123,208 B2
(45) Date of Patent: Feb. 28, 2012

(54) PROCESS FOR BINDING SHEETS

(75) Inventors: John Cracknell, Maidenhead (GB); Mark Firth, Chesham Bois (GB); John O'Brien, High Wycombe (GB); Alan Trew, High Wycombe (GB); Martin Brewster, High Wycombe (GB)

(73) Assignee: IBIS Integrated Bindery Systems Ltd., Buckinghamshire (GB)

( * ) Notice: Subject to any disclaimer, the term of this patent is extended or adjusted under 35 U.S.C. 154(b) by 529 days.

(21) Appl. No.: 10/587,873

(22) PCT Filed: Jan. 28, 2005

(86) PCT No.: PCT/GB2005/000313

§ 371 (c)(1),
(2), (4) Date: Jul. 16, 2007

(87) PCT Pub. No.: WO2005/072980

PCT Pub. Date: Aug. 11, 2005

(65) Prior Publication Data

US 2007/0272361 A1 Nov. 29, 2007

(30) Foreign Application Priority Data

Jan. 28, 2004 (GB) ..... 0401863.6
Aug. 6, 2004 (GB) ..... 0417567.5

(51) Int. Cl.
*B65H 37/04* (2006.01)

(52) U.S. Cl. ..... 270/52.18; 270/32; 270/46; 270/58.07; 270/58.08; 270/52.16; 270/52.26; 270/52.29

(58) Field of Classification Search ..... 270/20.1, 270/32, 37, 41, 45, 46, 51, 58.07, 58.08, 270/52.16, 52.18, 52.26, 52.29; 412/4, 6, 412/8, 18, 20, 25, 33, 37; 493/423, 424, 493/427, 436, 441
See application file for complete search history.

(56) References Cited

U.S. PATENT DOCUMENTS

| | | | | |
|---|---|---|---|---|
| 4,050,686 | A * | 9/1977 | McCain et al. | 270/52.09 |
| 4,106,148 | A | 8/1978 | Axelrod et al. | |
| 5,028,193 | A * | 7/1991 | Misicka | 412/8 |
| 5,044,873 | A | 9/1991 | Vijuk et al. | |
| 5,193,851 | A | 3/1993 | Honegger et al. | |
| 5,716,182 | A * | 2/1998 | Leu | 412/8 |
| 6,363,851 | B1 * | 4/2002 | Gerhard et al. | 101/483 |
| 6,994,337 | B1 * | 2/2006 | Cracknell et al. | 270/52.29 |
| 2001/0048862 | A1 | 12/2001 | Baumann et al. | |
| 2003/0044260 | A1 | 3/2003 | Grunder et al. | |
| 2004/0038794 | A1 | 2/2004 | Hoarau | |
| 2004/0214706 | A1 * | 10/2004 | Dannemann et al. | 493/405 |
| 2004/0222583 | A1 * | 11/2004 | Dannemann et al. | 270/32 |

FOREIGN PATENT DOCUMENTS

| | | |
|---|---|---|
| EP | 0 962 334 | 12/1999 |
| EP | 1 475 331 | 11/2004 |
| EP | 1 475 339 | 11/2004 |
| JP | 2003-136857 | 5/2003 |
| WO | 01/34403 | 5/2001 |

* cited by examiner

*Primary Examiner* — Leslie A Nicholson, III

(74) *Attorney, Agent, or Firm* — Volpe and Koenig, P.C.

(57) ABSTRACT

Binding apparatus and a related process are particularly suited for binding digitally-printed sheets into booklets. The apparatus is adapted to fold individual sheets and then to apply adhesive to the fold line before gathering the sheets in a collator ready for binding. The collator includes either a rotatable or retractable finger that is moveable to temporarily inhibit registration of a first sheet of a new stack on a stacking area, as a previous stack is transported away.

9 Claims, 13 Drawing Sheets

Arrows Show Direction of Movement When Extending

PROCESS FOR BINDING SHEETS

This invention relates to the field of printing, in particular to a process for binding individual sheets to form a book or section of a book.

Digital printing technology allows a printed image to be changed on each consecutive sheet that is supplied to a printer without stopping the printer to fit a new printing plate. This means that the sheets of a book can be printed in sequence. Digital printing therefore offers the potential for rapid collation of consecutive printed sheets into books or booklets. Alternative (more conventional) technologies, for example offset lithographic printers, adopt an approach in which each sheet of the book is printed a requisite number of times before moving to the next sheet. The individual sheets of the conventionally-printed book are only subsequently collated for binding. As a result of the ability to combine the printing and collation stages, digital printers are able to print short and medium sized runs of printed material far more quickly and at a lower cost than previously possible.

An in-line digital printing and book-binding apparatus is described in PCT patent application WO 01/34403A. In this, and other prior art digital printing systems, a continuous web is output from a printer that is digitally printed on both surfaces. To produce the finished book the printed web must be cut into sheets with each sheet forming two pages of the book printed on both sides. The individual sheets must then be folded, collated, covered, stitched and trimmed. The order of these operations may be varied, and this has led to the development of a variety of assemblies each suitable for implementing one or more process steps in the various stages of book production.

In conventional book binding machines, books are assembled by dropping different printed sheets onto a moving transport conveyor from a series of feed hoppers. By loading the first hopper with sheet 1, the second with sheet 2, etc., this ensures that the resulting piles of sheets formed on the transport conveyor contain sheets organised in the correct sequence. By way of contrast, digitally printed sheets are already output from the printer in their correct order and this enables the benefits of a fixed-position sheet collector to be realised. Fixed-position collectors stop a first sheet and enable subsequent sheets to be delivered in turn one on top of the other. Once all the sheets for one book have been stacked together, the fixed-position collectors then transport the stack of sheets out of the collector. Compared with conventional sheet collectors, such fixed-position collectors are simpler, more reliable, have fewer moving parts, are less liable to malfunction and breakage and may be fed directly from the printer.

Japanese patent 2003/136857 describes a process for gluing and stitching a small number of printed sheets to form a small booklet or catalogue. Glue is applied to the outside of a fold line on each sheet, the sheets are collated on a saddle and then saddle-stitched through the glue. These sheets are not digitally printed and, as a result, the printed sheets must first be gathered and output from a gathering machine in numbered order, but with intervals between. That is, this process is not suitable for use with a high-throughput digital printing process that can generate printed sheets in an almost continuous feed.

European patent application, published on 12 Mar. 2004 with number EP 1 475 331, describes a method of producing multi-page booklets. Printed sheets are folded and glued individually prior to assembly into the finished product. This document does not describe in any detail particular apparatus that is suitable for implementing this process.

It is an object of the present invention to provide an alternative binding mechanism that is capable of offering an overall improvement to the quality of binding for digital production of books or booklets.

Accordingly the present invention provides a process for binding sheets together, the binding process comprising the steps of: feeding successive individual sheets to a folding apparatus; folding each sheet along a fold line; applying adhesive to the fold line of selected sheets as they are passed over a supporting surface; and stacking successive sheets such that the fold lines of each sheet are substantially aligned.

This process offers the capability of rapid production of digitally-printed booklets, books or brochures. The folding, gluing and collation processes in accordance with this invention are relatively quick and so may be implemented with a practically continuous input of printed sheets. Prior art methods of book assembly are generally not capable of offering such a high throughput and so cannot exploit fully the potential offered by digital printing.

The adhesive may be applied to the outside of the fold line on all but the final sheet in a stack. Alternatively, and preferably, it is applied to the inside of the fold line of the second and subsequent sheets. If adhesive is applied to the inside of the fold lines of each sheet prior to the sheets being stacked, the risk is significantly reduced of adhesive accidentally coming into contact with regions of a sheet other than its fold line. Moreover, the structure of the fold line in the sheet acts as a natural barrier to movement or flow of the adhesive away from the fold line.

In an alternative aspect the present invention provides binding apparatus for binding sheets together, the apparatus comprising: sheet folding apparatus for individually folding sheets along a fold line; a supporting surface on which the sheets are supported as adhesive is applied from an adhesive applicator to the fold line of selected sheets prior to stacking; and a sheet collector for stacking successive sheets such that the fold lines of each sheet are substantially aligned. It is preferred that the adhesive applicator is mounted in or adjacent a slot in the supporting surface and is arranged to deliver adhesive upwardly through the slot to the inside of the fold line, for the advantages given previously.

The apparatus may be provided with adhesive applicators both above and below the supporting surface in order to give the apparatus flexibility in operation: glue may be applied to the inside and/or the outside of the fold as desired by the operator. In particular, glue may be applied to the outside of the fold of the final sheet in order to attach a cover sheet thereto.

With the fast production rates anticipated with use of this binding apparatus, in particular if used in conjunction with a digital printing process, collation becomes an important factor in the overall speed of the process. In particular, the time taken to remove one collated stack before a subsequent stack arrives for collation may ultimately limit the speed. Accordingly, if operated at near continuous feed, the sheet collector is preferably arranged to temporarily inhibit registration of a first sheet of a new stack on a stacking area whilst a complete stack of sheets is transported away.

In a further aspect therefore, the present invention provides a sheet collector comprising: a saddle for receiving sequential delivery of part-folded sheets; a front stop and back stop for encouraging alignment of the sheets into a stack; and a removal means for, on completion of the stack, transferring the stack outside of the collector; wherein the back stop includes a rotatable element arranged such that when in a first position the element forms an extension of the back stop and when in a second position the element protrudes from the back stop so as to form a finger which is capable of intercepting and holding sheets being delivered to the collector.

An embodiment of the invention will now be described by way of example only with reference to the accompanying drawings, in which.

Figure 7A:
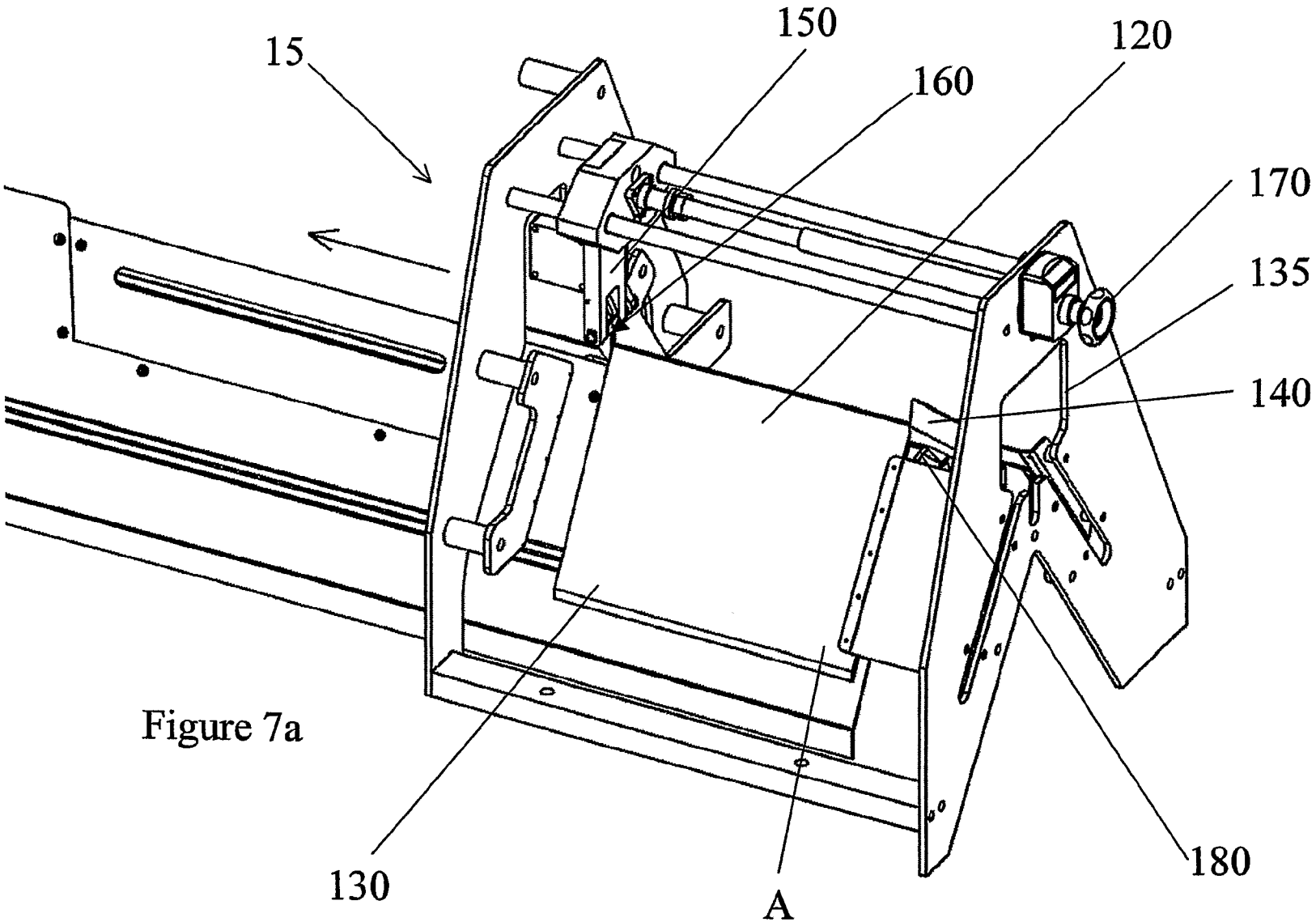
FIGS. 7*a*-7*i* show various stages in the sheet collection portion of the binding process.

FIG. 7*a* illustrates a sheet collector designed in accordance with an embodiment of the present invention, at an early stage of sheet collection.

Figure 7B:
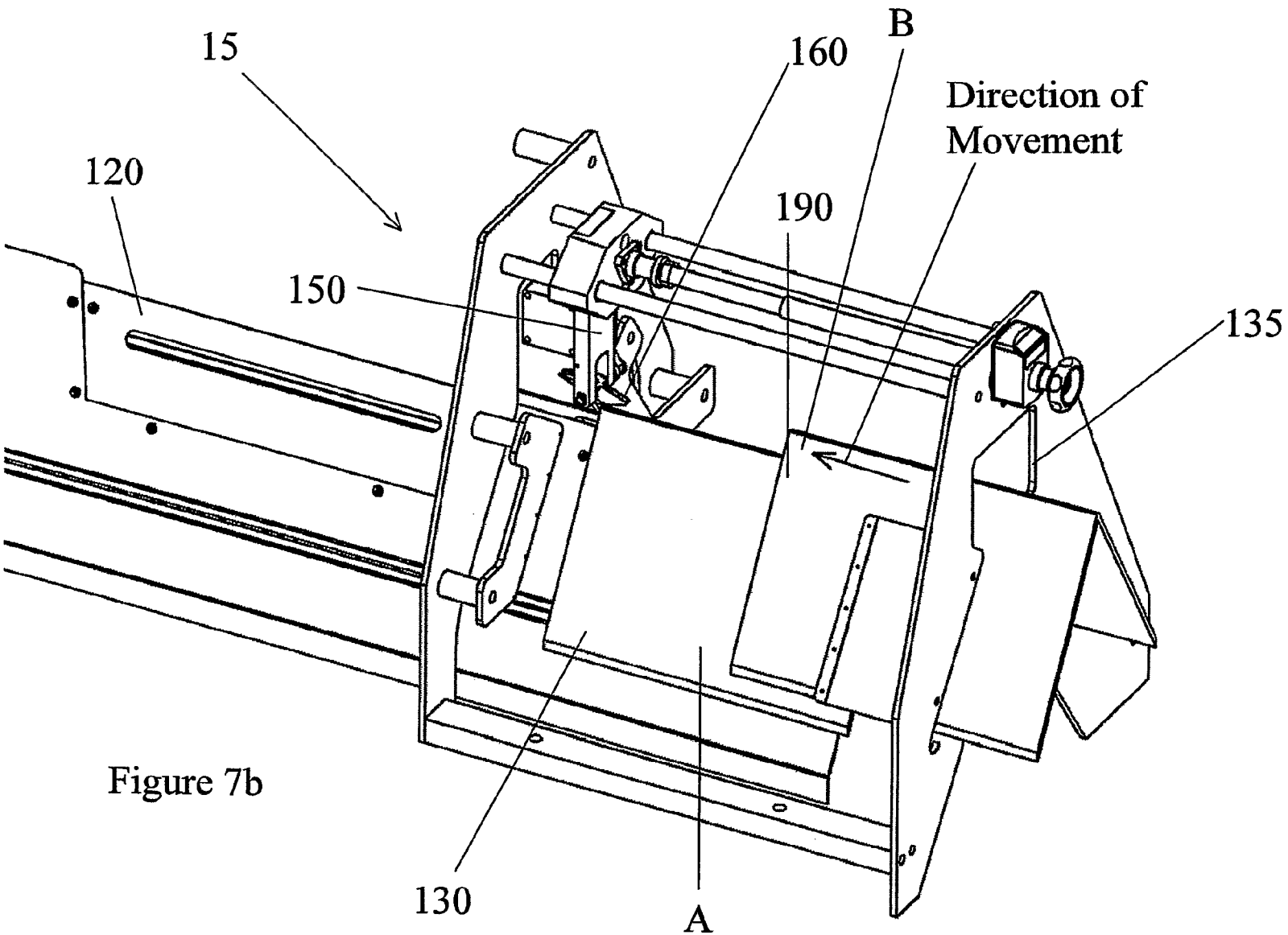

FIG. 7*b* illustrates the sheet collector of FIG. 7*a* at a later stage in the production process as a first sheet of a second book is delivered.

Figure 7C:
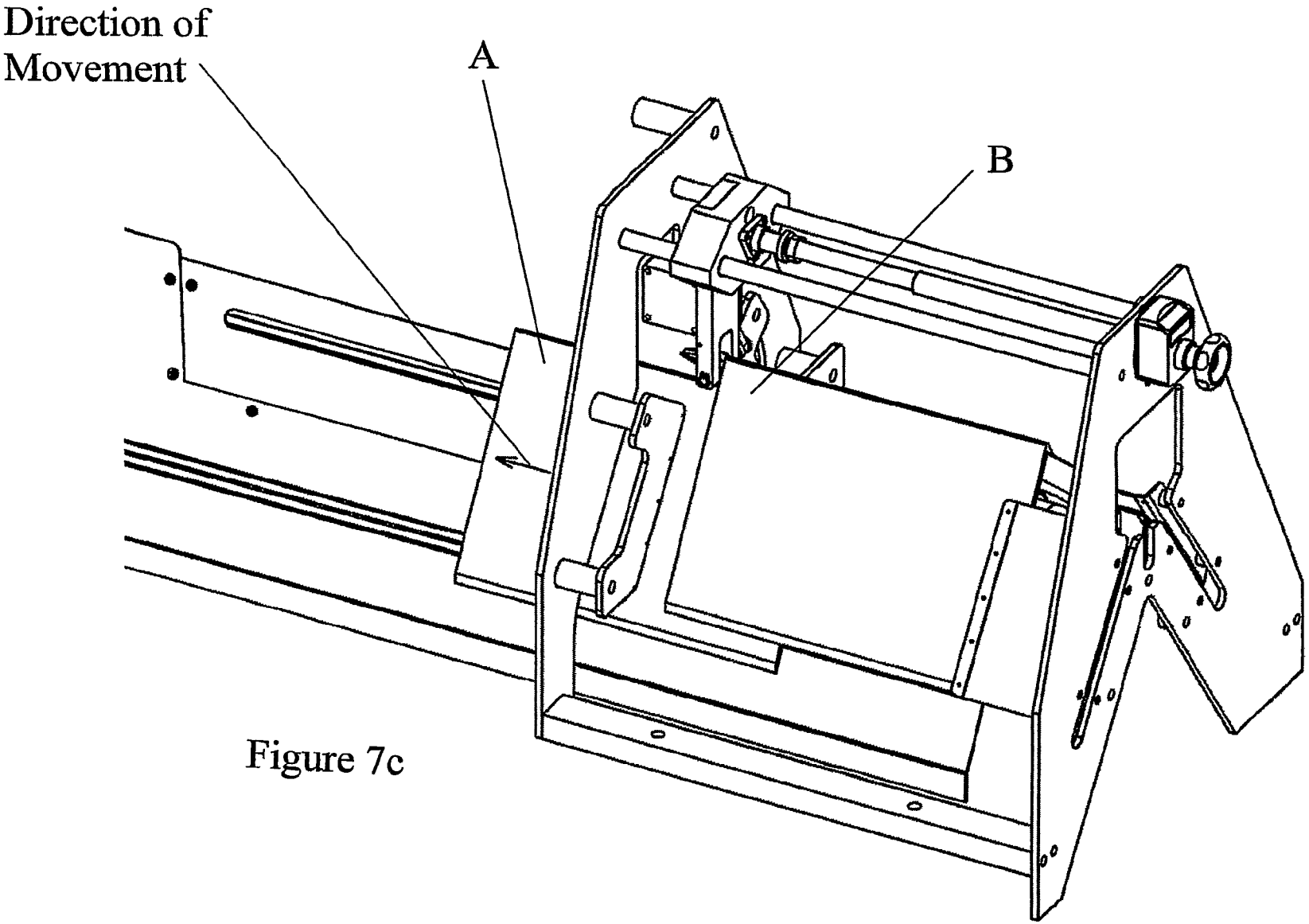
Figure 7D:
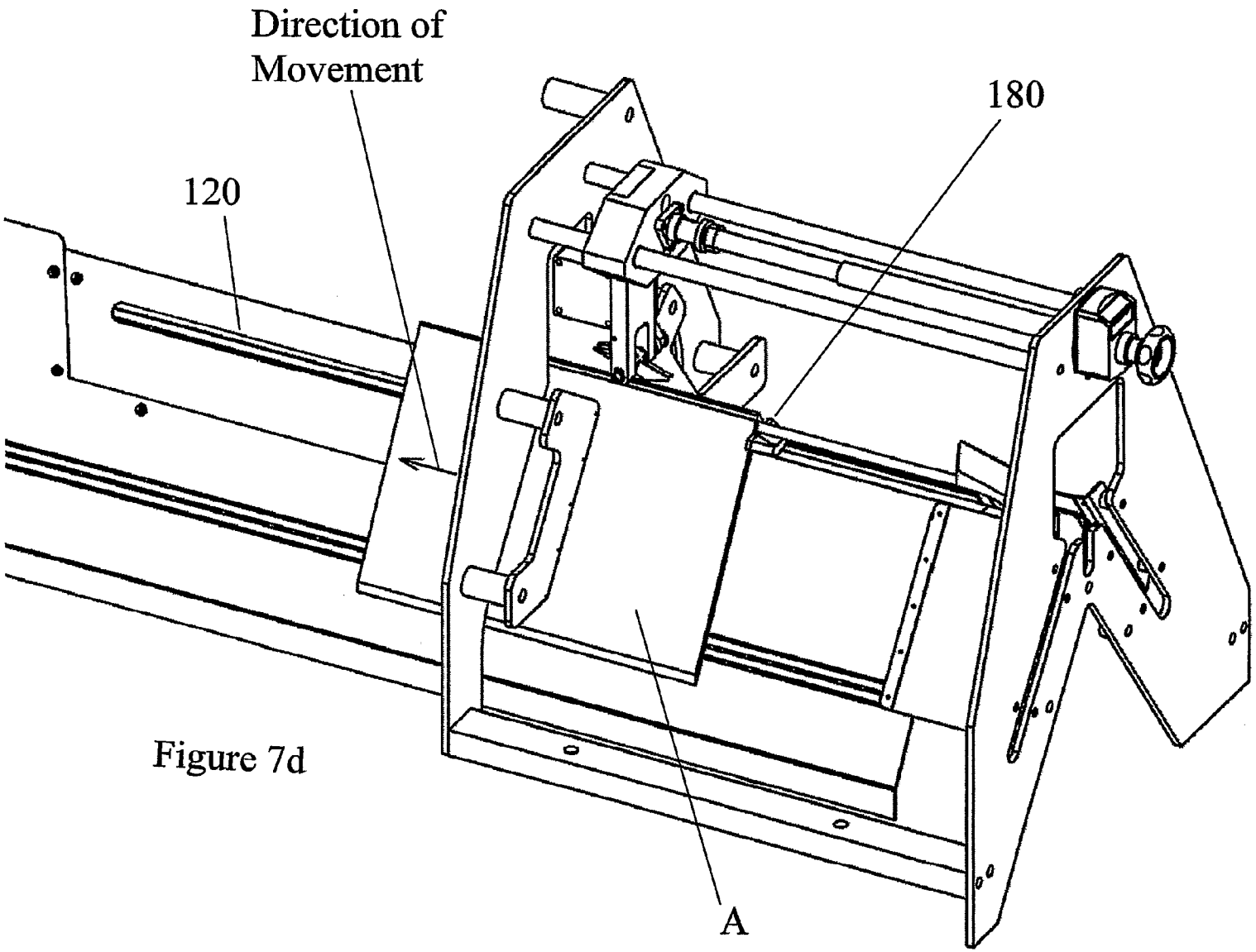

FIGS. 7*c* and 7*d* illustrate the sheet collector of FIGS. 7*a* and 7*b* during transition between collecting consecutive books.

Figure 7E:
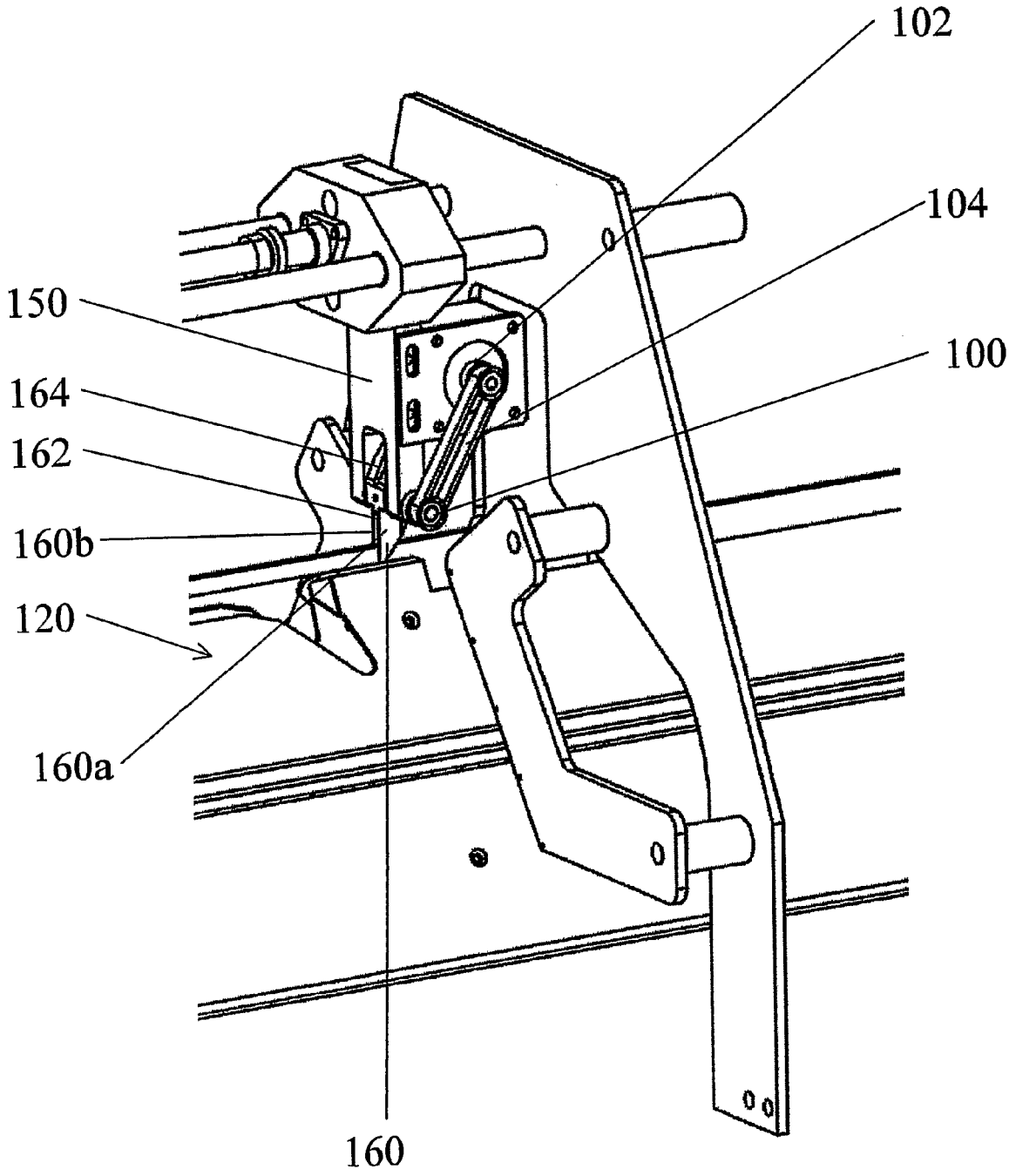
Figure 7F:
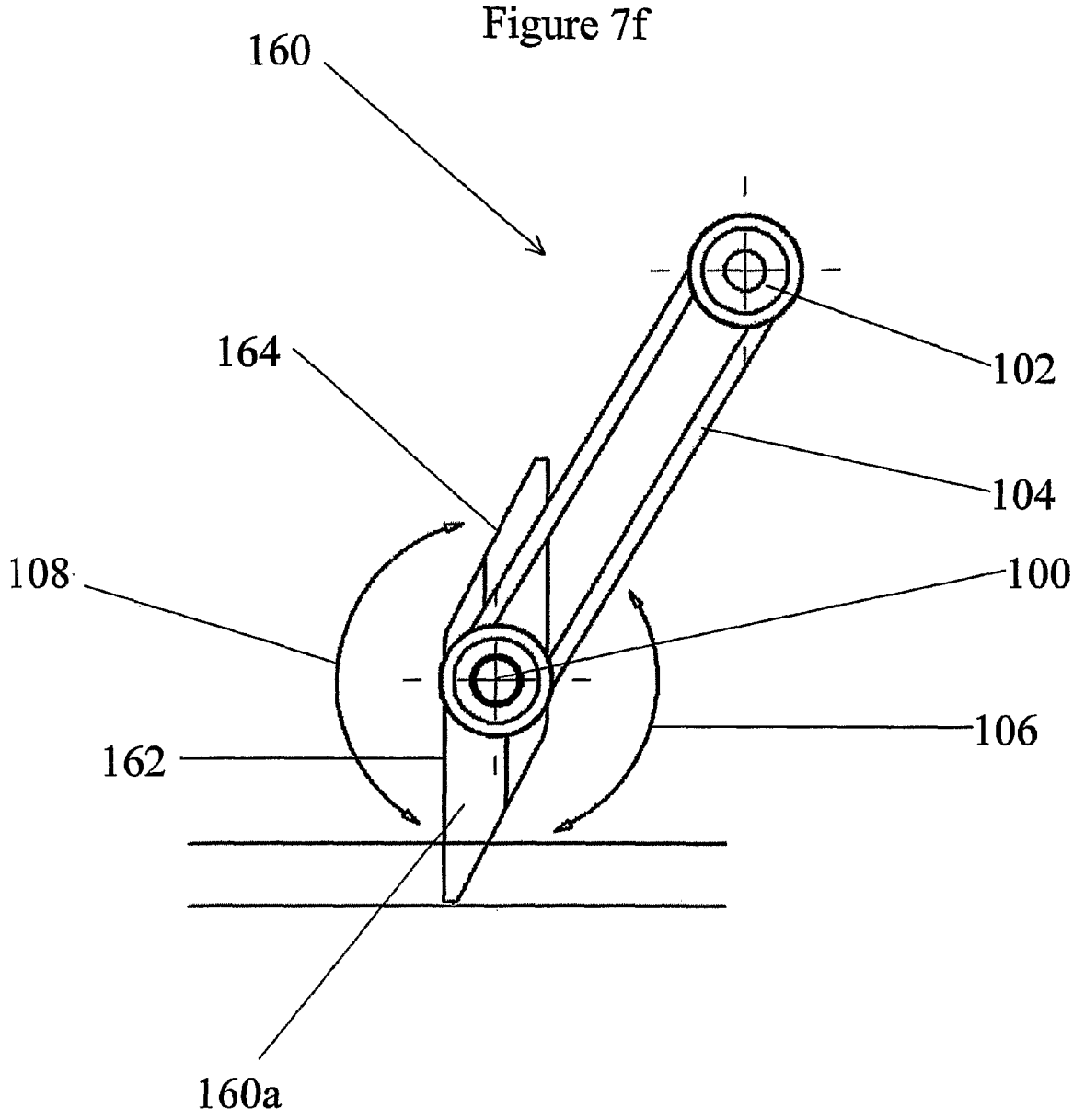

FIGS. 7*e* and 7*f* illustrate in more detail the rotary finger component of the collector in its first, vertical position.

Figure 7G:
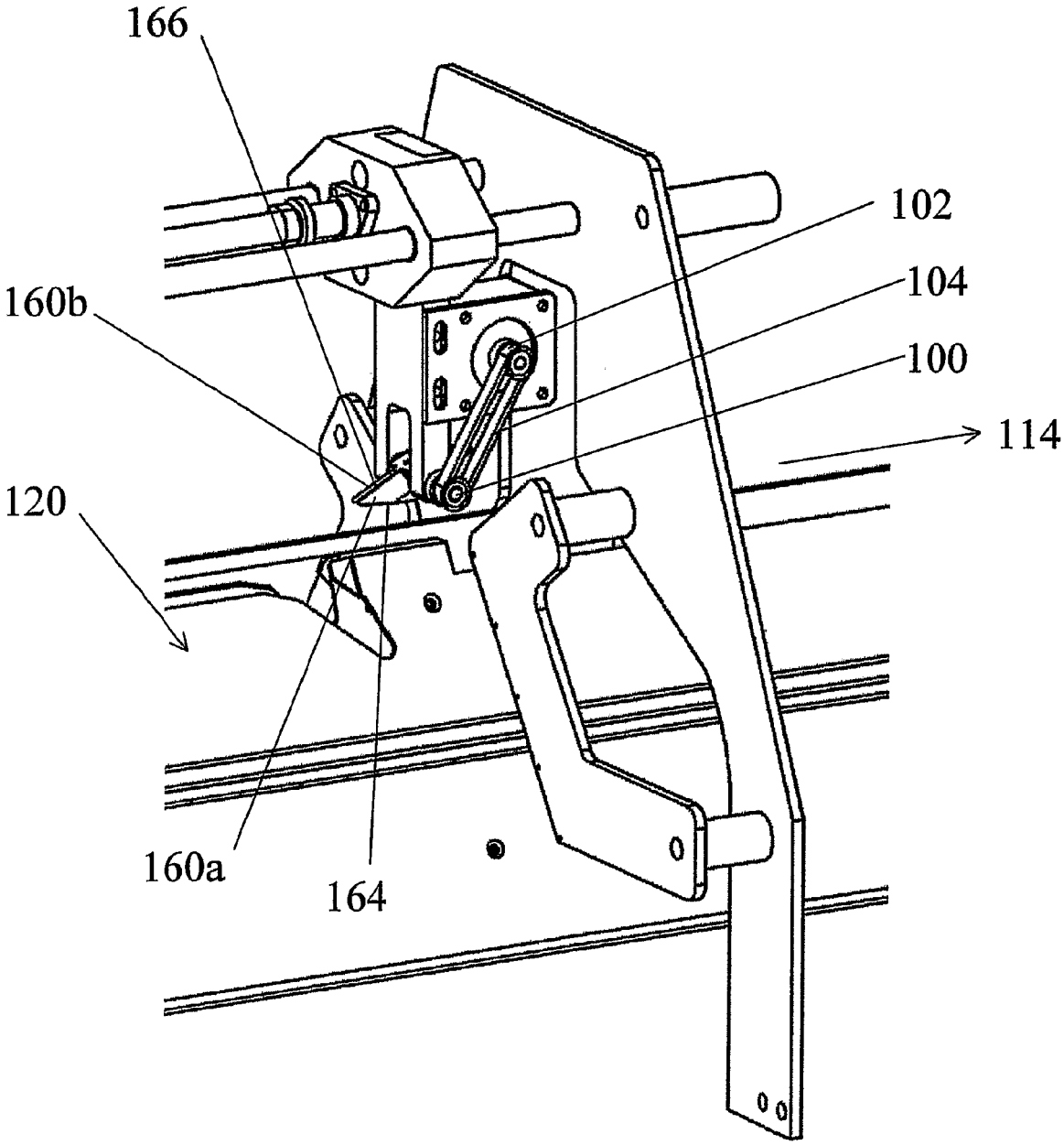
Figure 7H:
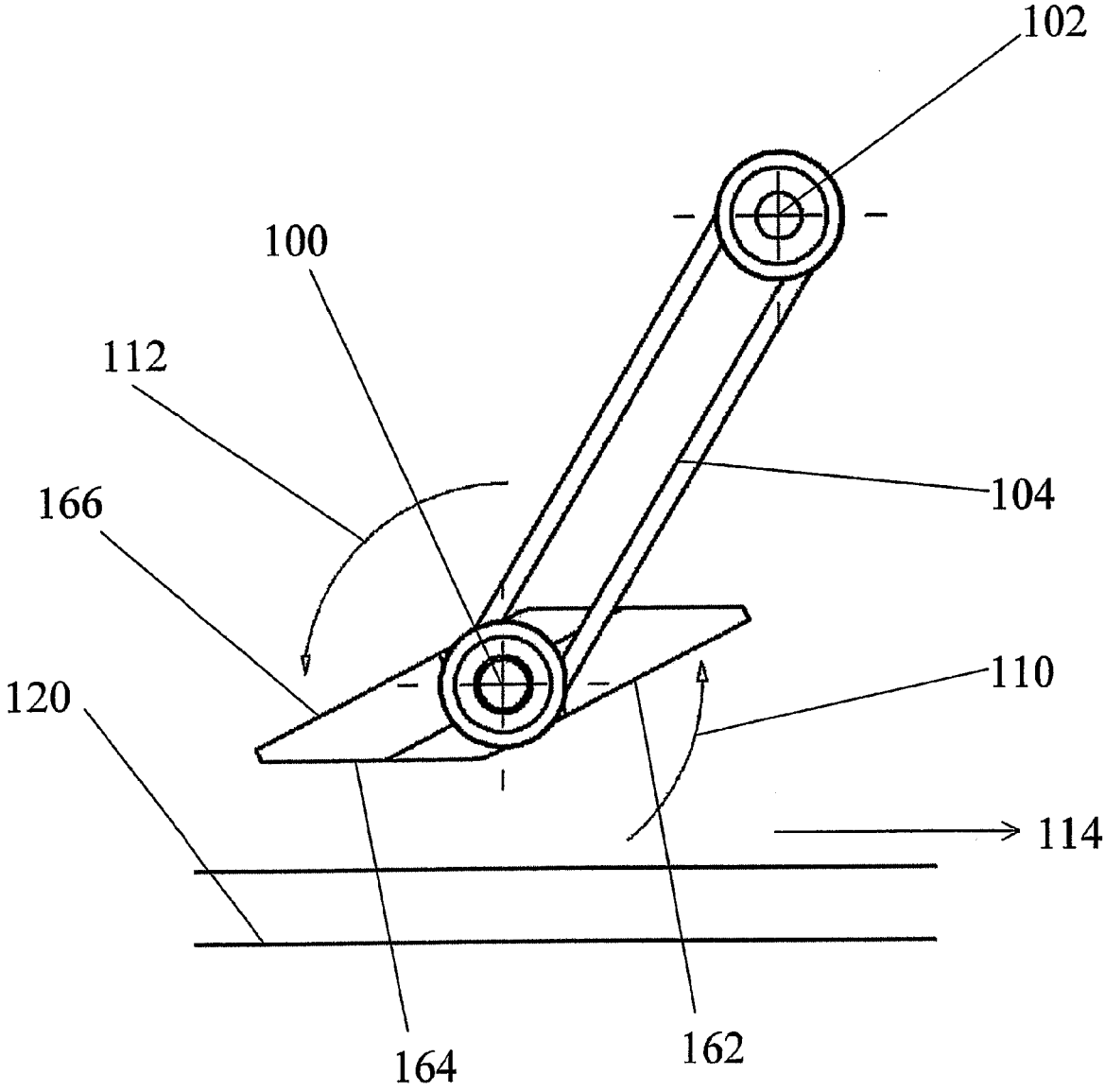

FIGS. 7*g* and 7*h* illustrate in more detail the rotary finger of FIGS. 7*d* and 7*e* in its second, horizontal position.

Figure 7I:
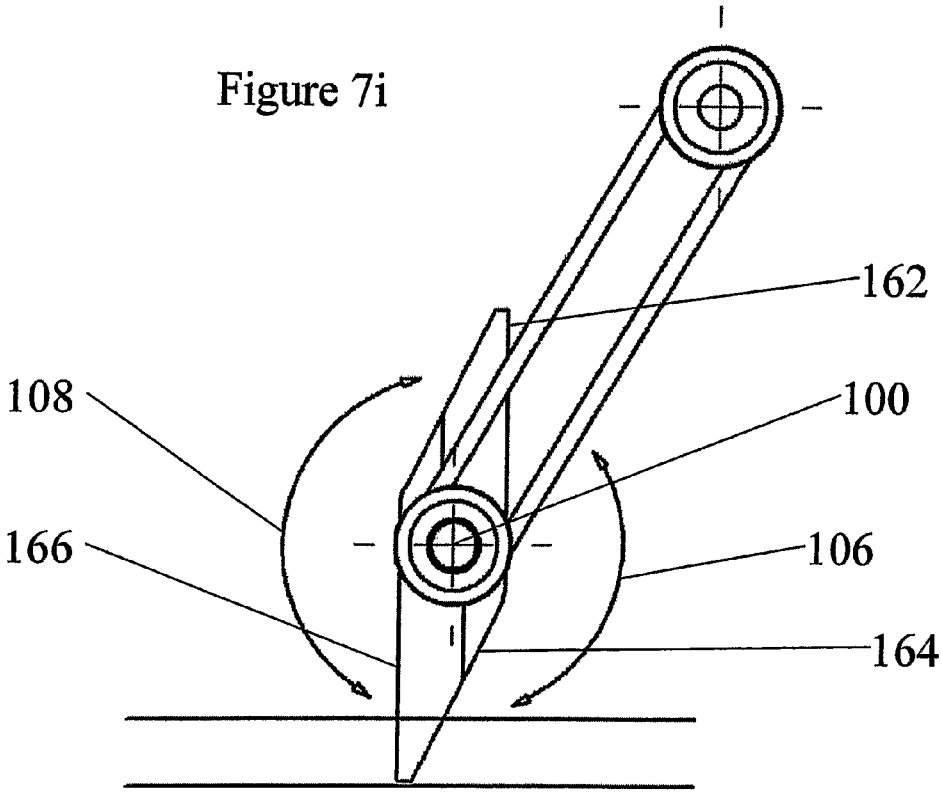

FIG. 7*i* illustrates the rotary finger having returned to its first, vertical position, but in a different orientation.

Figure 8:
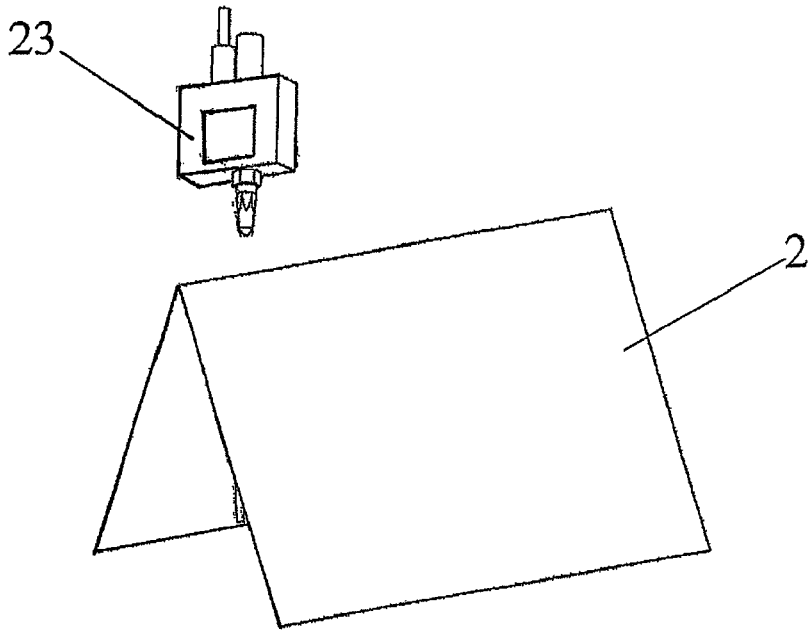

FIG. 8 illustrates the glue applicator mounted above the supporting surface.

Figure 9:
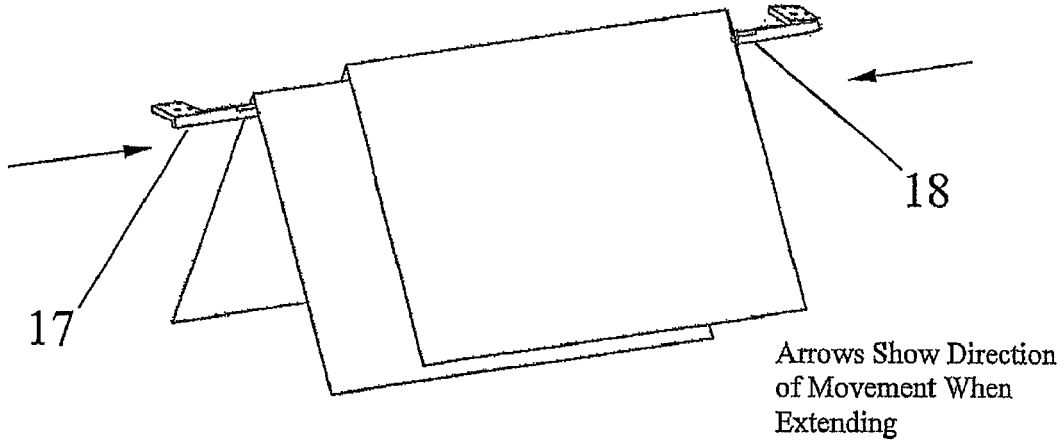

FIG. 9 illustrates the second retractable finger.

Figure 1:
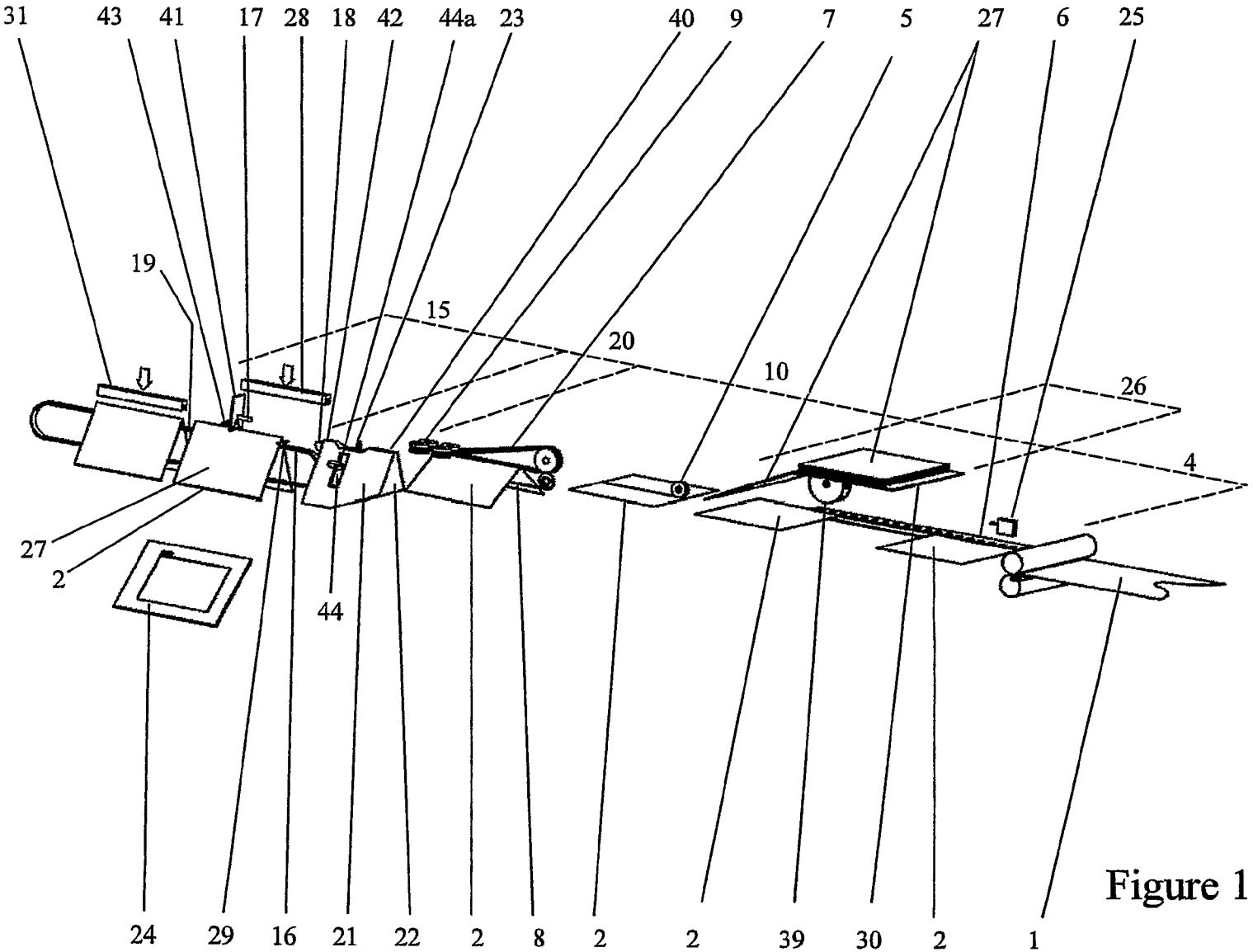
FIG. 1 is a schematic diagram of in-line binding apparatus in accordance with the present invention.
Figure 2:
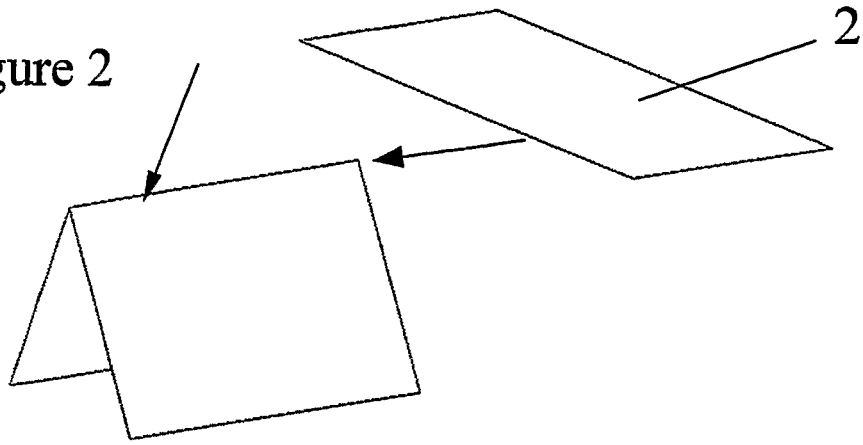
FIG. 2 illustrates a first stage in the binding process of the present invention in which a flat printed sheet is folded along a central line.
Figure 3:
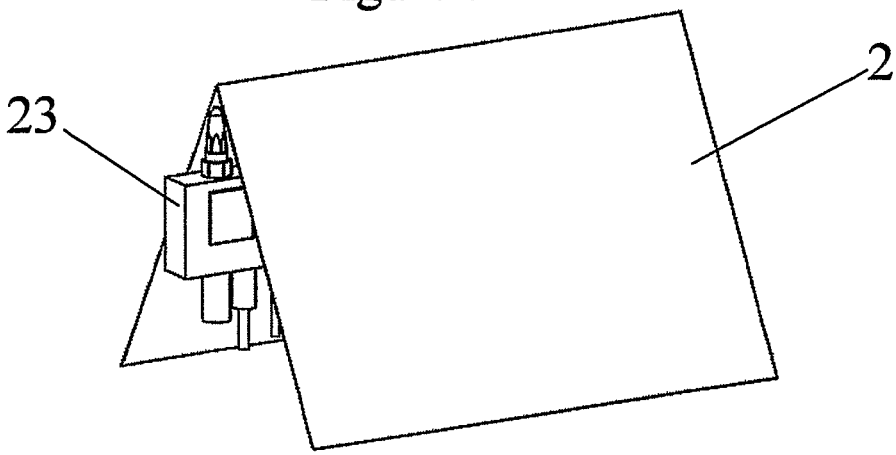
FIG. 3 illustrates a second stage in the binding process of the present invention in which glue is applied to a folded sheet.
Figure 4:
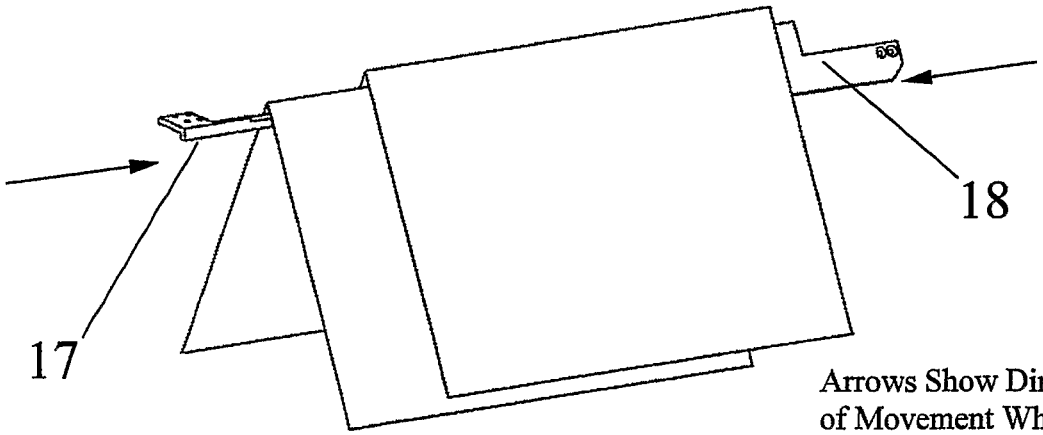
FIG. 4 illustrates a third stage in the binding process of the present invention in which glued sheets are collected on a sheet collector to form a book or part thereof.

FIG. 1 illustrates an in-line book assembly apparatus in which printed sheets leaving a digital printer are carried by a conveyor, or other transport system, through assemblies adapted for the various stages of book construction.

The in-line book assembly apparatus includes a cutter for cutting a web 1 that previously has been digitally printed on both sides into individual sheets 2. Each sheet 2 is sized such that each sheet 2 has two pages printed on each surface. Once the individual sheets 2 have been cut they are transferred successively to a conveyor 4. The conveyor 4 delivers the individual sheets 2 to a pair of scoring wheels 5, which are positioned centrally above and below the conveyor 4 (only the upper scoring wheel is visible in FIG. 1). The conveyor 4 includes an adjustable side guide 6 that is used to accurately align the centre of the sheet 2 with the scoring wheels 5. The centre line of each of the individual sheets 2, about which the sheets 2 are to be folded, is positioned by the side guide 6 so that the centre line lies parallel to the direction of travel of the sheet and is exactly aligned with the scoring wheels 5. Thus, as an individual sheet 2 passes though the pair of scoring wheels 5 the centre line of the sheet is accurately scored to define the fold line in the sheet 2.

Downstream from the scoring wheels 5, the in-line book assembly apparatus includes a sheet folding assembly 10 in which the individual sheets are folded in succession to form two pages of a book with each page having text printed on each side thereof. The sheet folding assembly 10 includes a series of folding belts 7,8 and a pair of nip wheels 9. The folding belts 7,8 are conventional in construction and arrangement, and consist of two upper, side belts 7 that are downwardly angled with respect to the feed direction and twisted inwardly towards a lower, central belt 8. In addition to folding the individual sheets the belts are also used to drive the pair of nip wheels 9. As a sheet 2 is carried forward by the folding belts 7,8 the side belts 7 urge the sides of the sheet inwards and downwards by virtue of the twist in the belts. A sheet 2 passing into the sheet folding assembly 10 is thus folded in half (or other, fixed, pre-determined proportion) about its fold line with each side or page hanging down either side of the central belt 8. The pair of nip wheels 9 is provided immediately after the folding belts 7,8 to further sharpen the fold in the sheet 2. The nip wheels 9 are positioned so as to engage each side of the sheet 2 immediately adjacent the fold line and are arranged to press the sides of the sheet together.

Figure 5:
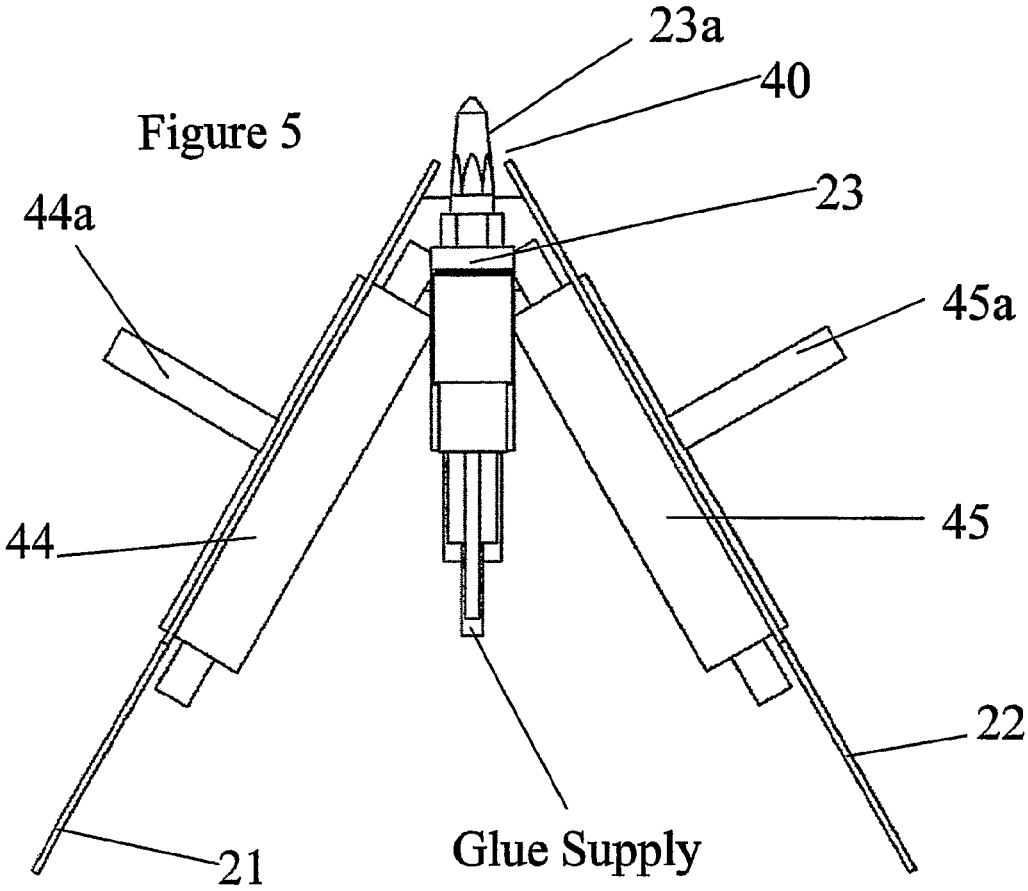
FIG. 5 is an end on view of a sheet transport extension for use in the in-line binding apparatus according to the present invention.

Downstream of the sheet folding assembly 10 the in-line book assembly apparatus further includes a sheet transport extension 20. Each folded sheet 2 is fed to the sheet transport extension 20 after leaving the nip wheels 9. The sheet transport extension 20 applies glue to the inside of the fold line for every sheet, except the first sheet, of each book or portion of a book passing through the sheet folding assembly 10. As can be more clearly seen from FIG. 5, the sheet transport extension 20, which is similar in structure to a saddle, incorporates two low friction support surfaces 21 and 22 which are separated along their upper edges by a slot 40 and arranged at an angle to each other such that they depend downwardly and outwardly from each other to form a broken inverted V-shape, in section. The sheet transport extension 20 also includes inner rotating rollers 44 and 45 and outer rotating rollers 44*a* and 45*a* which drive each sheet through the sheet transport extension 20 and guide each sheet 2 so that the fold line of each sheet passes over the slot 40.

A glue applicator 23, which also forms part of the sheet transport extension 20, is provided between the support surfaces 21 and 22 and is aligned with the slot 40 such that the nozzle 23*a* of the glue applicator 23 is positioned to apply cold glue along the inside of the fold line of the sheet 2. The glue is preferably applied as a line of individual dots of glue. It is to be understood, though, that hot glue, or a continuous line of glue may be applied in the alternative. Each folded sheet is then passed to the sheet collector 15.

Alternatively, the glue applicator 23 may be positioned between and above the support surfaces 21, 22 and aligned so as to apply glue to the outside of the fold line of the sheet 2. It may also be desirable to incorporate two glue applicators in this sheet transport extension 20: one above and one below 23 the slot 40 between the support surfaces. This enables glue to be applied to either (or both) the inside or the outside of the fold line, as required. For example, the final sheet before the cover may have glue applied to the outside of the fold line in order to bind an (unglued) cover sheet.

The collector 15 allows one complete book (or book section) to accumulate in a stack before the book (or book section) is transported out of the collector 15 to the book finishing assembly. Sheet collection is an important part of the assembly process, and must be adapted from conventional collector mechanisms if the full potential of digital printing technology is to be exploited. Due to the speed and regularity of sheet delivery from a digital printer, the collector must be capable of pushing out a collected book whilst still allowing the first sheet of the next book to enter and start stacking within the collector.

Leading into the collector 15 shown in FIG. 1 is a carrier, preferably in the form of an elongate rod, which has a low friction surface for engagement with the inner surfaces of the folded sheet adjacent to the fold line. The diameter of the carrier is selected so that the inside of the sheet fold line, where the glue has potentially been applied, is supported away from and is not in contact with the upper surface of the carrier. The velocity of the sheets emerging from the sheet transport extension 20 is selected so as to be sufficient for the momentum of the sheets to cause the sheets to travel along the carrier to the collection or stacking area of the collector 15 without any further drive means or externally applied force.

The collection area extends downstream of the carrier and terminates at a back-stop 41. The back-stop 41 is preferably in the form of an upstanding plate which intersects the transport direction of at least the first sheet of every book (or book section) and acts to locate the leading edge of the sheet as the sheet is delivered to the collection area. The back-stop 41 is manually adjustable to permit the collection area to accommodate different book spine lengths. Alternatively, the position of the back-stop downstream of the carrier may be automatically adjusted under the control of a central control unit 24.

Mounted on the back-stop 41 is a retractable downstream finger 17 which is movable in the sheet transport direction between a first extended position in which the downstream finger 17 projects into the collection area from the back-stop 41 and a retracted position in which the downstream finger 17 lies flush with or downstream of the back-stop 41.

The collector also includes a pair of retractable upstream blades 18 that are mounted beneath the carrier and are movable between a first extended position in which the upstream blades extend beyond the downstream end of the carrier to project into the collection area and a second retracted position in which the upstream blades 18 preferably do not extend beyond the downstream end of the carrier. The upstream blades 18 are arranged substantially parallel but at an angle to each other and with a gap between them so that the upstream blades do not contact any glue that has been applied to the inner surface of the fold line of a sheet. It will, of course, be apparent, that the upstream blades 18 may be replaced by a finger similar to the downstream finger or that the downstream finger may comprise a pair of blades similar to the upstream blades 18.

The downstream finger 17 and the upstream blades 18 are arranged to cooperate so as to catch respective downstream and upstream edges of a folded sheet 2 as it travels past the end of the carrier into the collection area. Subsequent reciprocal retraction of the downstream finger 17 and the upstream blades 18 then causes the folded sheet to fall under gravity to start a new stack of sheets. The back-stop 41 is provided to halt the forward motion of the folded sheet and to locate the leading edge of the folded sheet in the desired stacking position. Similarly, the front-stop 42 is provided to locate the trailing edge of the folded sheet to ensure that as the sheets are stacked in the collection area, the sheets are in registry with one another.

A collection arm 16 is located in the collection area, immediately below the downstream finger 17 and the upstream blades 18, on which the individual sheets are stacked to form a book (or book section). A knock-up finger 43 is also provided on the back-stop 41 which acts to maintain the downstream registration of the sheets during stacking. Once the stack of sheets is complete, a pusher member 29 on a conveyor 19 engages with the upstream edge of the completed stack of sheets on the collection arm 16 and urges the stack of sheets to travel away from the collection area towards the book finishing assemblies. Downstream movement of the stack of sheets causes the knock-up finger 43 to move so as to permit passage of the stack.

In a modification of this collector design, the upstream blades 18 (or finger) are dispensed with. The pusher member 29 is set to engage with the earlier stack so as to displace it at least slightly downstream before the first sheet of the new stack arrives in the collection area. The trailing edge of this new sheet is then free to fall under gravity onto the vacated upstream end of the collection arm 16, whilst its leading edge is supported by the extended downstream finger 17. The sheet remains in this position as the pusher member 29 completes removal of the earlier stack from the collection area. At this point, the downstream finger 17 is retracted as before and the first sheet completes its drop onto the collection arm 16.

A sensor 25 is positioned on the sheet conveyor 4 and is used to scan index markings (for example bar codes) printed on the sheets in order to identify the last sheet of a book (or book section). When the last sheet is identified by the sensor 25, after a short delay to allow the last sheet time to arrive at the collection area, the finger 17 and blades 18 are extended to catch the first sheet of the next stack whilst the existing stack of sheets is moved out of the collection area.

An alternative design of collector 15 is shown in FIGS. 7*a*-7*i*. This design, instead of employing a downstream finger that is retractable in the transport direction, makes use of a finger that is rotatable about an axis substantially transverse to the sheet transport direction. The rotatable finger is moveable between the same first extended position as the retractable design and a second position in which it is substantially aligned with the plane of the back-stop 41.

With reference to FIG. 7*a* the collector 15 in accordance with this alternative design has a fixed saddle area 120 designed to receive part-folded sheets in an inverted V form. In this Figure first and second sheets 130 of a first book A are shown on the saddle 120. They are delivered to the saddle through a suitably shaped (inverted V) entranceway 135 cut in the collector frame. A fixed front stop 140 and adjustable back stop 150 for accurate alignment of sheets are located near the saddle 120. A rotary finger 160, which assists in providing more accurate alignment, is located beneath the back stop 150 and oriented in its first, vertical position. An adjustment mechanism 170 is used to set the distance between front 140 and back 150 stops to the correct sheet length. A push out finger 180 can be operated to deliver completed books to a stitching system (not shown) ready for the next stage of the assembly process.

FIG. 7*b* is an illustration of the same collector system 15 at a later stage of the collation process. At this stage a first sheet 190 of a second book B is delivered through the entranceway 135. Rotary finger 160 is now oriented in its second, horizontal position. FIGS. 7*c* and 7*d* illustrate the collector 15 at the next stage of the process. In these figures all components previously referred to are like-referenced.

Referring to FIGS. 7*a*, 7*b*, 7*c* and 7*d* the operation of the collector 15 will now be described. During the first stage of the process, as illustrated in FIG. 7*a*, the sheets are delivered individually through the entranceway 135 above the height of the saddle 120. When a far side of each sheet hits the back stop 150, that sheet falls onto the saddle 120, aligned initially by the stops 140, 150. As sheets are delivered, they accumulate on the saddle 120. At this stage the rotary finger 160 is oriented in its first, vertical position. As will be explained later in more detail, it is also arranged to oscillate in this position. Thus, as it registers arrival of the sheets, each is effectively shaken into alignment against the front stop 160.

A process controller (not shown) is connected to the collector 15 and also to sensors (25, FIG. 1) located upstream of the collector 15. These sensors pick up bar-coded marks on each sheet as it passes. In this way a count is made of the number of sheets being delivered to the collector 15 and, by means of the bar code, the process controller is able to register the last sheet of a book. A signal from the process controller activates the collector 15 to operate in changeover mode once the last sheet of a book has been delivered.

FIG. 7*b* illustrates the situation once a predetermined number of sheets (of Book A) have accumulated on the saddle 120 and as the first sheet 190 of Book B is delivered through the entranceway 135. As soon as the last sheet of Book A is placed on top of the other sheets the rotary finger 160 moves to its second, horizontal position.

FIGS. 7*c* and 7*d* illustrate the next stage of this process. FIG. 7*c* differs in that the Book B is not shown for clarity, but the situations shown are identical timewise. With reference first to FIG. 7*c* the rotary finger 160 is shown in its second position. In this orientation, the finger 160 catches a front edge of the first sheet of Book B as it falls towards the saddle 120 and holds it up, clear of the saddle 120 and previous Book A, in this raised position. At the same time, referring to FIG. 7*d*, and before a back edge of Book B has time to complete its drop onto the saddle 120, the push out finger 180 begins to push the completed Book A along the saddle 120. Once clear of the collector 15, Book A is delivered to the next stage of the assembly process.

After the stage shown in FIGS. 7*c* and 7*d*, the rotary finger 160 returns to its first, vertical position, as previously referred to in FIG. 7*a*. The first sheet 190 of Book B drops down with the finger rotation onto the saddle 120 and the process of accumulation of all sheets in this subsequent book takes place as described above for Book A. In the embodiment of the collector 15 shown, pushing out of the completed book is performed sufficiently quickly that only the first sheet of the subsequent book need be held by the rotary finger 160. Clearly however, if a slower collector is constructed, or sheet delivery rate increased, the rotary finger 160 may support more than one sheet, as required.

With reference to FIGS. 7*e* to 7*i*, the structure of the rotary finger 160, in particular in facilitating its transition between first and second positions will now be described in greater detail.

FIG. 7*e* is a close-up illustration of the collector 15 of FIG. 7*a* in the vicinity of the back stop 150 and rotary finger 160. FIG. 7*f* is a further close up illustrating the structure of the rotary finger 160 in greater detail. In both these figures the finger 160 is shown in its first position. That is, while collecting and bringing into alignment sheets of the same book. The finger 160 itself is machined from a single block. In order to minimise inertia, an aluminium block is preferred. The finger 160 is in the form of two symmetric plates 160*a*, 160*b*, each in the shape of a parallelogram, which are joined at their central region. An axle 100 runs through the central region in a direction normal to the plates 160*a*, 160*b*. The connected plates 160*a*, 160*b* are free to rotate about the axle between the finger's first, vertical position and second, horizontal position. When in its first position (as shown in FIGS. 7*e* and 7*f*), the plates 160*a*, 160*b* drop below and to either side of an uppermost part of the inverted V-shaped saddle 120. In this position the plates 160*a*, 160*b* present a vertical edge 162 to the direction of sheet delivery. A second, slanted edge 164 is held clear of the saddle 120 and above the axle 100. A motor 102 and drive belt 104 are connected to the axle 100 in order to drive the rotation and also an oscillation. The oscillation axis is also that of the axle 100, as indicated by double-headed arrows 106, 108 in FIG. 7*f*.

During a stacking phase of the sheets of a single book, the finger 160 is in its first position with the plates 160*a*, 160*b* extending below the tip of the saddle. The plates 160*a*, 160*b* therefore act as backstops and so help prevent movement of the sheets in a lateral direction. Moreover, in order to further encourage alignment of the sheets, the drive mechanism 102, 104 is driven in oscillation mode and the finger 160 reciprocates against the sheets, pressing them into alignment against the front stop 140.

Once the final sheet of a book is stacked and the first sheet of the subsequent book is being delivered i.e. at the stage shown in FIG. 7*b*, the drive mechanism 102, 104 is driven to rotate the finger 160 to its second position. This position is illustrated in FIG. 7*g* and, from a closer perspective, in FIG. 7*h*. Components common to these Figures and to FIGS. 7*e* and 7*f* are like-referenced.

In moving from the first, vertical position to the second, horizontal position the finger 160 is rotated in an anticlockwise direction, as viewed in FIGS. 7*e* to 7*h*. Single-headed arrows 110, 112 in FIG. 7*h* indicate this rotation. Thus, the previously vertical edge 162 is moved backwards away from the sheet stack comprising the first book on the saddle 120 until the second, previously slanted edge 164 lies parallel with the longitudinal direction of the saddle 120. In this way the plates 160*a*, 160*b* are kept clear of the stacked sheets. Once in this second, horizontal position, a third plate edge 166 is ready to receive and hold up sheets of a subsequent book as they are delivered to the collector. Meanwhile, the complete stack is pushed out of the collector below the finger 160, in the direction indicated by arrow 114.

Once the completed stack has been removed, the drive mechanism 102, 104 is driven to complete a 180° rotation of the finger and the third plate edge 166 is brought into a vertical presentation (see FIG. 7*i*), allowing the first sheet of the subsequent book to drop fully onto the saddle 120. Once in this position, remaining sheets are accumulated as before, with the finger 160 once again being oscillated by the drive mechanism 102, 104 in order to encourage more exact alignment. Alternative parallel edges of the plates 160*a*, 160*b* therefore act as backstops for collection of consecutive books. The other pair of parallel edges similarly act as holding edges on alternate changeover cycles.

Returning once more to FIG. 1, subsequent stages in the book assembly process will now be described. As can be seen from FIG. 1 in particular, cover sheets 27, if used, simultaneously pass through the various stages of the process in a similar manner, either on top of one of the sheets 2 or in the gaps between sheets 2. Each cover sheet 27 may also have glue applied to the inside of its fold, and arrives in a position so that it can be laid over the top of the stack of sheets in the sheet collector 15.

Figure 6:
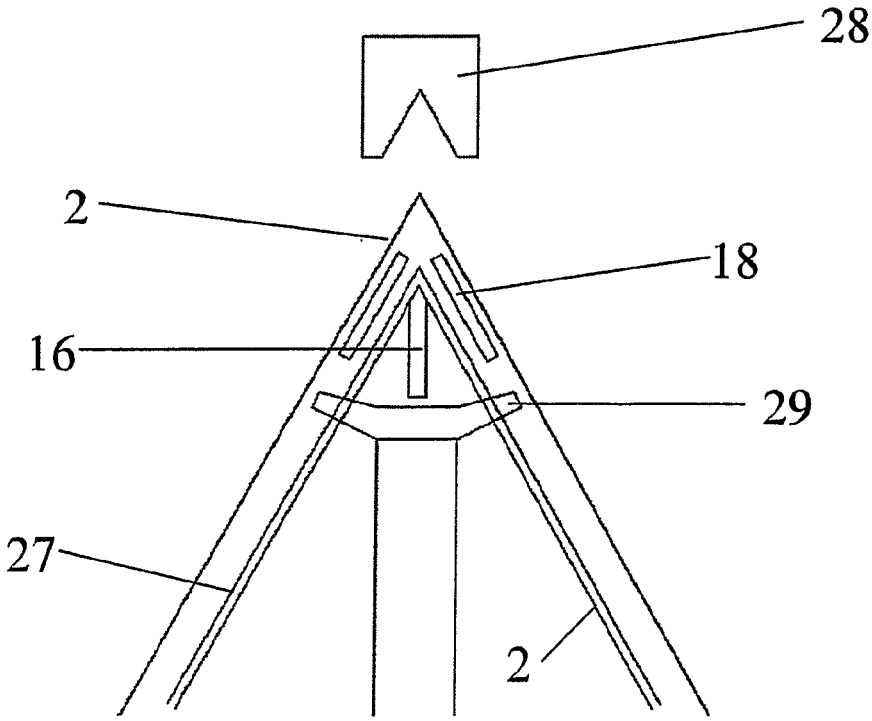
FIG. 6 is an end on view of a pressing down anvil for use in the in-line binding apparatus according to the present invention.

The collector 15 further includes a pressing down anvil 28 which is shown more clearly in FIG. 6, and omitted from FIGS. 7*a*-7*i* for clarity. The anvil 28 is situated above the collection area and is positioned so as to be aligned with the fold lines of the sheets as they are stacked on the collection arm 16. The anvil 28 is movable downwardly to engage the spine of the fold lines of the sheets being stacked in the event there is an interruption in the input sheet stream. That is to say, in the event of an interruption in the sheet supply stream the anvil 28 is moved to apply downward pressure to the fold lines of the sheets 2 to ensure full adhesive contact between individual sheets in the partial stack. The contacting surface of the anvil 28 is shaped so as to generally correspond to the V-shape of the folded sheets in the stack of sheets. Activation of the anvil 28 is initiated by the detection of an interruption in the supply of sheets to the collector 15. The detection of an interruption is preferably by means of a sensor upstream from the sheet folding assembly 10.

As mentioned earlier, once all the glued sheets of a book (including a separately fed cover, if applicable) are in place on the collection arm 16 or saddle 120, the conveyor 19 moves forward and the pusher finger 29, 180 projecting upwardly from the conveyor 19 engages the edge of the stack of sheets and pushes the stack forward to the next stage of the assembly process.

The cover feeder 26 is only required when the cover to the book is in a different material, for example laminated, or is printed in colour whereas the remainder of the book is printed in monochrome. The cover feeder 26 has a table 30 on which the cover sheets 27 are stacked. From the table 30 a cover 27 is fed, using a vacuum separation system 39, in the stream of sheets so as to immediately follow the final sheet of a book and is then registered and centred with respect to the scoring wheels 5 in the usual manner. The cover is fed through the scoring wheels 5 to define a fold line for the cover and the scored cover is then fed to the folding belts 7, to the nip wheels 9 and then to the sheet transport extension 20 which, in one embodiment, applies glue to the inside of the fold in the cover 27 in a similar manner to that employed for applying glue to the individual sheets 2.

Alternatively, if a cover 27 is to be applied directly on top of the final sheet 2, then the underside of the cover 27 or the upper side of the final sheet 2 may receive a line of glue prior to the cover 27 and the final sheet 2 coming together as they enter scoring wheels 5.

In this way each cover 27 is folded, has glue applied to it (if required) and is introduced over the top of a stack of sheets in the collector 15. Sensors (not shown) may be used to automatically monitor the size and shape of the covers so that the score line in the cover is accurately positioned centrally to the cover. Alternatively, fine adjustment may be performed manually.

The back-stop 41, 150 and front-stop 42, 140 in the sheet collector 15, plus the reciprocating knock-up finger 43 or rotating finger 160 ensure the covers and the other sheets within each book are registered, preferably within 0.2 mm. The back-stop 41, 150 is adjustable so that its position may be altered to accommodate different sheet and cover lengths. As mentioned earlier, adjustment of the back-stop may be performed manually or may be under the control of the central control unit 24.

The conveyor 19 moves the completed stack of sheets 2 (with a cover 27 if required) forward to the book presser 31 which presses the stack of sheets and the cover together along the spine of their aligned fold lines. The conveyor 19 then urges the stack of sheets 2 forward to a trimming assembly where the stack is trimmed to the requisite size and shape employing known techniques and apparatus.

The in-line binding apparatus and process described above enables the pages of a book or the pages of a section of a book to be securely held together by means of glue.

The apparatus and the process may be used for making both thick and thin glued books with digitally or conventionally printed sheets. If the books are very thick then they will comprise a number of glued sections (with for example, six sheets per section) which are collected together and glued again (with hot glue) before the cover is applied. Thinner glued books may be made from one large section (up to fifty sheets for example, which are folded, glued, and collected on top of one another with a cover on top). It is clear from FIG. 1 that the origin of the printed sheets 2 is immaterial. That is, they may arrive at the assembly apparatus from a digital printer, conventional printer or a mixture of both. The apparatus is designed for rapid assembly of individual sequentially-printed sheets, such as output from a digital printer, but it is by no means restricted to this application. Sequential sheets from alternative printing sources may also be assembled and glued in this manner.

In addition, the same process may be used for producing books in which the sheets 2 and cover 27 are bound together by the use of wire staples. In this case the cold glue nozzle 23 is inhibited and the book presser 31 is removed to be replaced with a wire stapling device. In this way books may be produced which are either glue bound or wire staple bound, both from the same machine.

In applying glue to the inside of the fold line of the folded sheet, the risk is significantly reduced of the glue accidentally being wiped by an adjacent sheet in comparison to a situation in which glue is applied to the outside of the fold line of the folded sheet. The reason for this is that the glue on the underside of an upper sheet will only contact the sheet below when the spine of the upper sheet settles on top of the spine of the lower sheet.

Further and alternative features of the in-line binding process are envisaged without departing from the scope of the present invention as claimed.

The invention claimed is:

1. Binding apparatus for binding sheets together, the apparatus comprising:

sheet folding apparatus for individually folding sheets along a fold line;

a supporting surface, comprising two support surfaces that are inclined with respect to each other and separated at their upper edge by a slot with an opening, the opening being of sufficient width to receive a nozzle of an adhesive applicator, on which the folded sheets are supported as adhesive is applied from the adhesive applicator to the fold line of selected sheets prior to stacking; and a sheet collector for stacking successive sheets such that the fold lines of each sheet are substantially aligned.

2. Binding apparatus as claimed in claim 1 wherein the adhesive applicator is mounted above the supporting surface and is arranged to deliver adhesive downwardly onto the outside of the fold line.

3. Binding apparatus as claimed in claim 1, wherein the supporting surface includes one or more driven rollers to urge passage of a sheet along the surface.

4. Binding apparatus as claimed in claim 1, wherein the sheet collector comprises a stacking area with collection arm and a first retractable finger arranged above a downstream end of the stacking area.

5. Binding apparatus as claimed in claim 4, wherein the collector also comprises a second retractable finger, the second retractable finger being arranged above the stacking area.

6. Binding apparatus as claimed in claim 1, wherein the sheet collector comprises a stacking area for receiving sequential delivery of part-folded sheets and a finger located above a downstream end of the stacking area and arranged for rotation about an axis substantially transverse to the sheet transport direction.

7. Binding apparatus as claimed in claim 1, wherein the sheet collector comprises:

a saddle for receiving sequential delivery of part-folded sheets;

a front stop and back stop for encouraging alignment of the sheets into a stack; and a removal means for, on completion of the stack, transferring the stack outside of the collector; wherein the back stop includes a rotatable element arranged such that when in a first position the element forms an extension of the back stop and when in a second position the element protrudes from the back stop so as to form a finger which is capable of intercepting and holding sheets being delivered to the collector.

8. Binding apparatus for binding sheets together, the apparatus comprising:

sheet folding apparatus for individually folding sheets along a fold line;

a supporting surface, comprising two support surfaces that are inclined with respect to each other and separated at their upper edge by a slot on which the folded sheets are supported as adhesive is applied from an adhesive applicator mounted in or adjacent the slot to the fold line of selected sheets prior to stacking; and a sheet collector for stacking successive sheets such that the fold lines of each sheet are substantially aligned; wherein the adhesive applicator is arranged to deliver adhesive upwardly through the slot to the inside of the fold line.

9. Binding apparatus as claimed in claim 8, wherein the adhesive applicator is arranged to deliver adhesive to the second and subsequent sheets of a stack.

* * * * *